US005749172A

United States Patent [19]

Isopahkala

[11] Patent Number: 5,749,172

[45] Date of Patent: May 12, 1998

[54] RETRACTABLE BALCONY GLASS STRUCTURE

[76] Inventor: Jouko Isopahkala, Hirvisentie 20, 60200 Seinajoki, Finland

[21] Appl. No.: 511,304

[22] Filed: Aug. 4, 1995

[30] Foreign Application Priority Data

Aug. 17, 1994 [FI] Finland ..... U940412

[51] Int. Cl.[6] ..... E05D 15/26

[52] U.S. Cl. ..... 49/127; 49/124

[58] Field of Search ..... 49/127, 125, 126; 160/202, 218

[56] References Cited

U.S. PATENT DOCUMENTS

| | | | |
|---|---|---|---|
| 3,303,612 | 2/1967 | Baker | 49/127 |
| 3,334,375 | 8/1967 | Hubbard | 49/127 |
| 3,654,732 | 4/1972 | Schacht | 49/127 |
| 5,088,236 | 2/1992 | Karhu | 49/127 |
| 5,272,839 | 12/1993 | Karhu | 49/127 |

*Primary Examiner*—Anthony Knight
*Assistant Examiner*—Curtis Cohen

[57] ABSTRACT

The subject assembly is intended for use in selectively closing in balconies and is made up of an upper guide, a lower guide and several panel subassemblies. The upper guide is attached to the ceiling of the balcony and the lower guide to the floor or top of the railing. Each panel subassembly is made up of a rectangular glass panel, an upper fitting attached to its upper edge, and a lower fitting attached to its lower edge. One guide fitting and one pivoted guide fitting assembly are attached to the upper fitting and two guide fitting assemblies, one pivoted, are attached to the lower fitting. The guide fitting and fitting assemblies slide in the guides. The pivoted guide fitting assemblies allow the subassemblies to pivot about an axis near one vertical edge. A roller is attached to each guide fitting assembly on the lower fitting and the rollers carry the weight of the panel subassemblies. One panel subassembly is permanently positioned at the retracted end of the guides. To retract the assembly the permanently positioned subassembly is opened and the others are sequentially moved to the retracted end and opened. The upper guide fitting assemblies are engaged by a leaf spring to lock the subassemblies in the retracted position. During assembly extension, as each subassembly is turned to re-engage the guides, a cam on the upper guide fitting assembly engages the end of the spring to unlock the subassembly. The lock springs are attached to the inner surface of the outer flange of the upper guide.

2 Claims, 3 Drawing Sheets

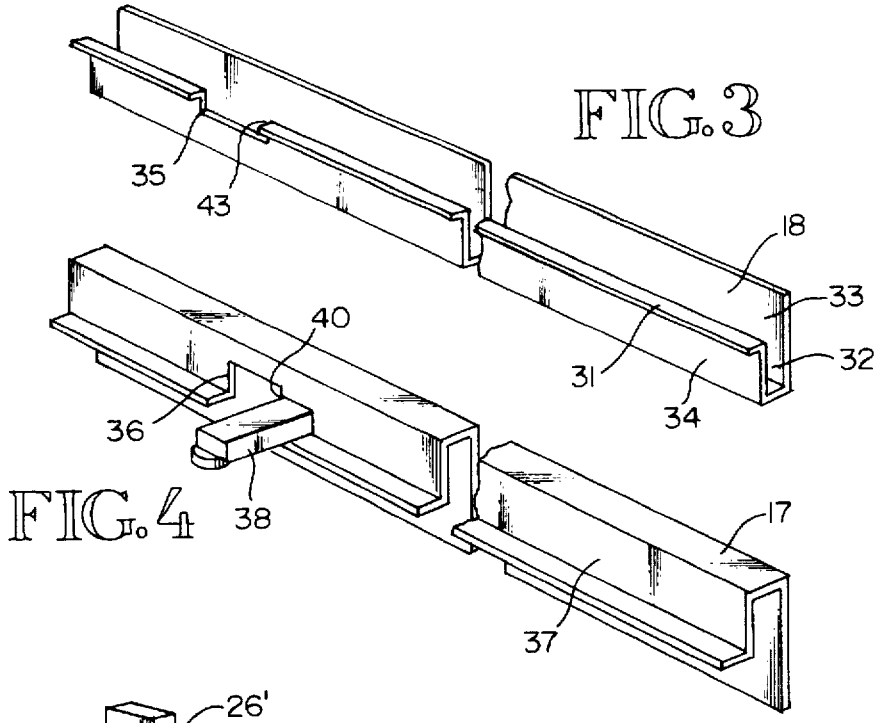
FIG. 3
FIG. 4
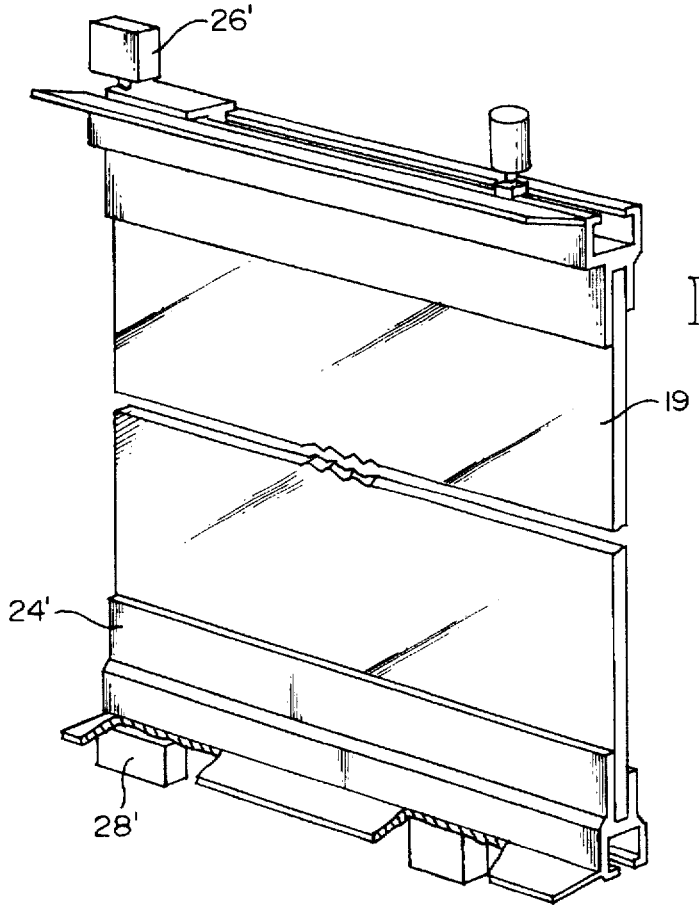
FIG. 5

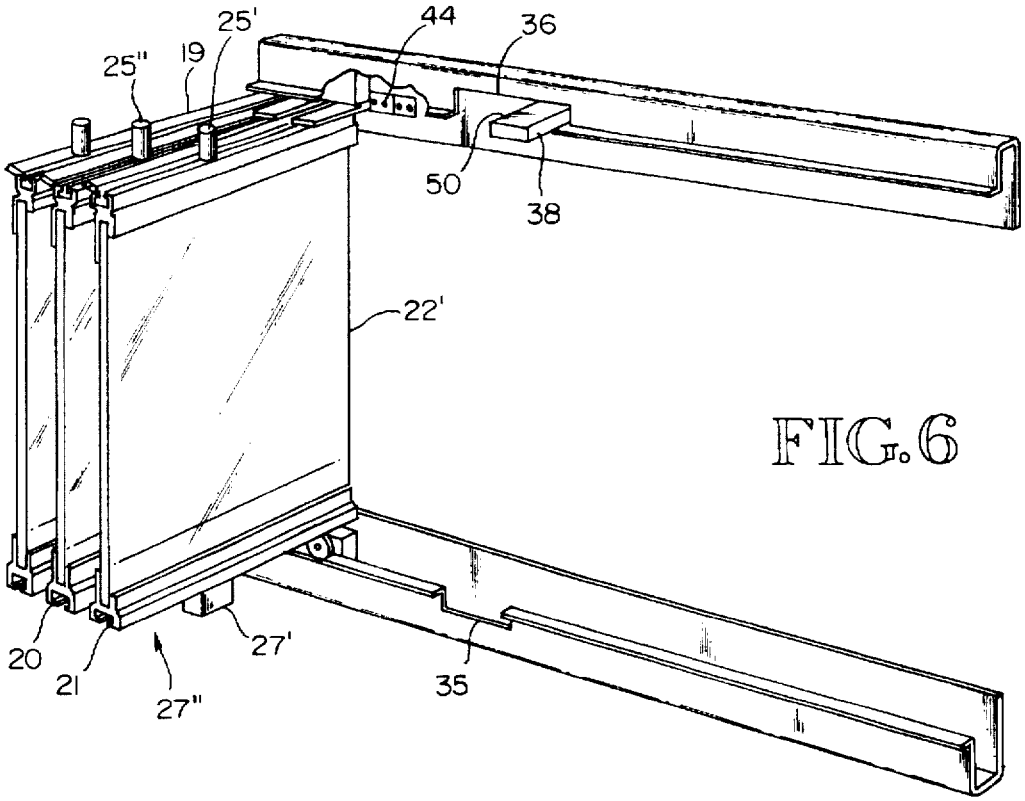
FIG. 6
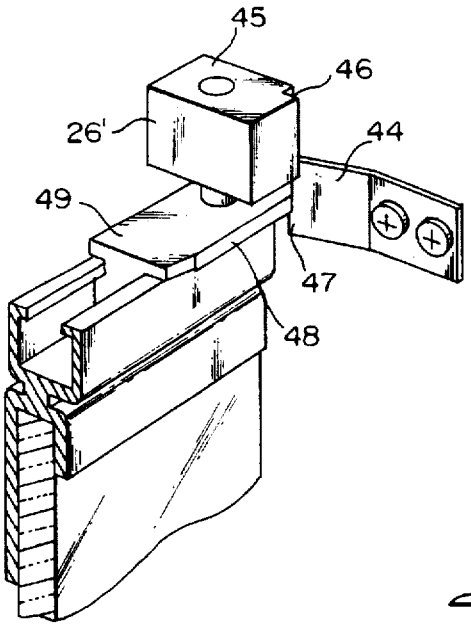
FIG. 7
FIG. 8
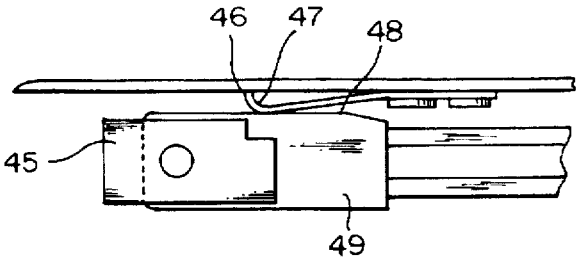

RETRACTABLE BALCONY GLASS STRUCTURE

BACKGROUND OF THE INVENTION

1. Field

The subject invention is in the general field of extensible/retractable panel assemblies such as those used to provide temporary partitioning of a room or temporary closure of a doorway and in the particular field of such assemblies used to enclose the space between the ceiling or roof and floor of a balcony or, if the balcony has a railing, between the roof or ceiling and the top of the railing. In some such assemblies the panels of the assembly are interconnected by hinges and extension and retraction are accordion-like. In others the panels are on separate tracks and move telescopically relative to each other. In still others each panel is hinged individually and the hinged edges of the panels are movable to one end of the opening served by the assembly with all the panels essentially normal to the plane of the opening when the assembly is retracted. The subject invention is in the specific field of this type of panel assembly.

2. Prior Art

The subject application is based on a Finnish PCT application U940412, filed Aug. 17, 1994. The patents listed below are a further sampling of the prior art in the specific field of the subject invention. U.S. Pat. Nos. 3,654,732 and 3,303,612, issued to Schacht and Baker respectively, are close prior art, along with the U.S. Patents issued to Karfu, a Finnish inventor.

| | | | |
|---|---|---|---|
| 81879 | Finnish | 3,654,732 | U.S. |
| 84654 | Finnish | 5,088,236 | U.S. (Finnish Inventor) |
| 3,303,612 | U.S. | 5,272,839 | U.S. (Finnish Inventor) |
| 3,334,375 | U.S. | | |

In the assembly of patent 81,879 the mechanism which locks the pivoted edges of the panels in place when the panels are opened and positioned next to each other are considered to be weak and therefore unreliable and not durable. In the assemblies shown in both the Finnish patents the panels are supported on rollers which engage a guide or rail attached to the ceiling or roof. When the panels are opened and adjoining, the full weight of the panels is supported by a relatively short length of the guide or rail tending to dislodge the guide or rail. The assembly of Schacht is supported from below. However, when the assembly is retracted the assembly is behind a non transparent panel, numbered 108 which blocks some of the viewing area. Also, retraction of the assembly requires operation of a lever on each panel in succession to disengage one of the two guiding elements on each panel from the upper structure of the assembly to allow turning the panel for storage. This feature is considered to be complicated to manufacture and operate. Also, no mechanism is provided for locking the panels in the stored (retracted) condition.

The panels of the partition of Baker are supported from above and, to permit swinging the panels for retraction, each panel must be manually tilted (see FIG. 7 in Baker's patent) to disengage one of the fittings on the lower edge of the panels from the lower guide. This operational feature is considered to be inconvenient and cumbersome. Also, Baker's mechanism for locking the panels in the retracted condition involves rotating a hinge fitting on each panel in the upper guide plus a lever cam, a compression spring and a pin in a slot. This mechanism is considered to be overly complicated.

Accordingly, the prime objective of the subject invention is to provide a panel assembly, in the specific field defined above, in which the panels are supported from below, extension and retraction do not require manipulation of levers or the panels and the locking mechanism for retaining the panels in their retracted positions is simple and reliable.

SUMMARY OF THE INVENTION

The subject invention is an extensible/retractable panel assembly. With the panels made of glass, the assembly is used to selectively close off the opening of a balcony between the ceiling or roof of the balcony, i.e. the upper surface, and the floor or railing top, i.e. the lower surface. The assembly extends from a side surface at one end of the balcony to the side surface of the other end, i.e. between the side surfaces of the balcony. The surface of the assembly facing outward from the balcony is the outer surface and the surface facing toward the balcony is the inner surface. A number of panel subassemblies are supported in the guides. The panel assembly is in its closed (extended) condition when the subassemblies are positioned edge to edge between the sides of the balcony and in its retracted condition when each of the subassemblies has been moved edgewise in the guides toward one side, termed the retraction side, and rotated 90° about an axis near the panel subassembly edge nearest the side. In this condition the panel subassemblies are close to each other, with their inner and outer surfaces interfacing with each other.

Each panel subassembly comprises a rectangular panel, having top and bottom edges and side edges, a top fitting attached to and extending across the top edge, a bottom fitting attached to and extending across the bottom edge, a guide fitting and guide fitting assembly attached to the top fitting and two guide fitting assemblies attached to the bottom fitting. The guide fittings and fitting assemblies are engaged with the guides. The guide fitting assembly attached to the upper fitting and one of the guide fitting assemblies attached to the lower fitting are pivotally connected so that the panel subassemblies can rotate about a vertical axis near a vertical edge. Each of the guide fitting assemblies attached to the lower fitting comprises a roller which rides on a horizontal flange on the lower guide. The rollers carry the weight of the panel subassembly.

The panel subassembly nearest the retracted side is permanently installed and pivots with its pivot axis close to the retraction side. During retraction of the panel assembly this panel is first pivoted 90° inward, i.e. toward the balcony. Then the adjacent panel subassembly is moved edgewise until the top guide fitting assembly and one of the guide fitting assemblies on the lower fitting contact the top and bottom guide fittings of the first panel subassembly. This panel is then also turned inward 90° and the turning is made possible by notches in the inner walls of the upper and lower guides which allow the non pivotally connected guide fitting and the lower guide fitting assembly to move out of the guides as the panel assembly pivots on the pivots of pivotally attached guide fitting assemblies.

When the guide fitting assembly is in position to be moved through the notch in the wall of the channel of the lower guide the roller attached to it is no longer on the support flange for the rollers. This tends to allow the panel assembly to tilt but this tilting is prevented by engagement of the top pivotally attached guide fitting with a lock spring attached to the inner side of the outer wall of the guide. The spring is a leaf spring and it engages a notch in the fitting. There is a lock spring for each movable panel subassembly.

This engagement prevents the upper end of the panel subassembly from motion in the direction of the tilt tendency. Also, as the panel subassembly is pivoted the non-pivotally connected guide fitting engages a cam surface and/or a roller on an arm which extends inward from the upper guide adjacent to the notch in the guide and assists in the stabilizing of the panel subassembly. As explained below, the cam action of this fitting on this arm serves to relieve load on the locking spring when the panel assembly is being extended.

Retraction of the panel assembly is completed by moving and pivoting the remaining panel subassemblies as described. The non-pivotally attached guide fitting and guide fitting assembly are positioned radially on the panel subassemblies so that they can pass through the notches even though the pivot axis of each subassembly is closer to the notches as the panel subassemblies accumulate near the retracted side.

During extension of the panel assembly, the panel subassemblies are pivoted in sequence to reengage the non-pivotally connected guide fitting and guide fitting assembly with the guides and then moved into their respective extended positions. During the pivoting, the non-pivotally connected guide fitting re-engages the roller and/or cam surface on the arm and this engagement moves the fitting which engages the lock spring such that it relieves the locking load. A cam on the pivotally connected top guide fitting engages the free end of the lock spring and moves it out of the notch in the fitting so that the panel subassembly can be moved along the guides. When all the movable panel subassemblies are moved to their extended condition positions the permanently positioned panel subassembly is closed. It is locked closed by sliding its lower non-pivotally connected guide fitting such that that fitting cannot clear the notch.

The invention is described in more detail below with reference to the attached drawings. Some of the drawings are out of proportion to better show details.

BRIEF DESCRIPTION OF THE DRAWINGS

FIG. 3 illustrates the lower guide.

FIG. 4 illustrates the upper guide.

FIG. 5 illustrates a specialized panel subassembly.

FIG. 6 illustrates the assembly with all panel subassemblies retracted.

FIG. 7 illustrates a lock spring engaged with a guide fitting.

FIG. 8 is a schematic section illustrating the disengagement of the lock spring and the guide fitting.

DETAILED DESCRIPTION OF THE INVENTION

Figure 1:
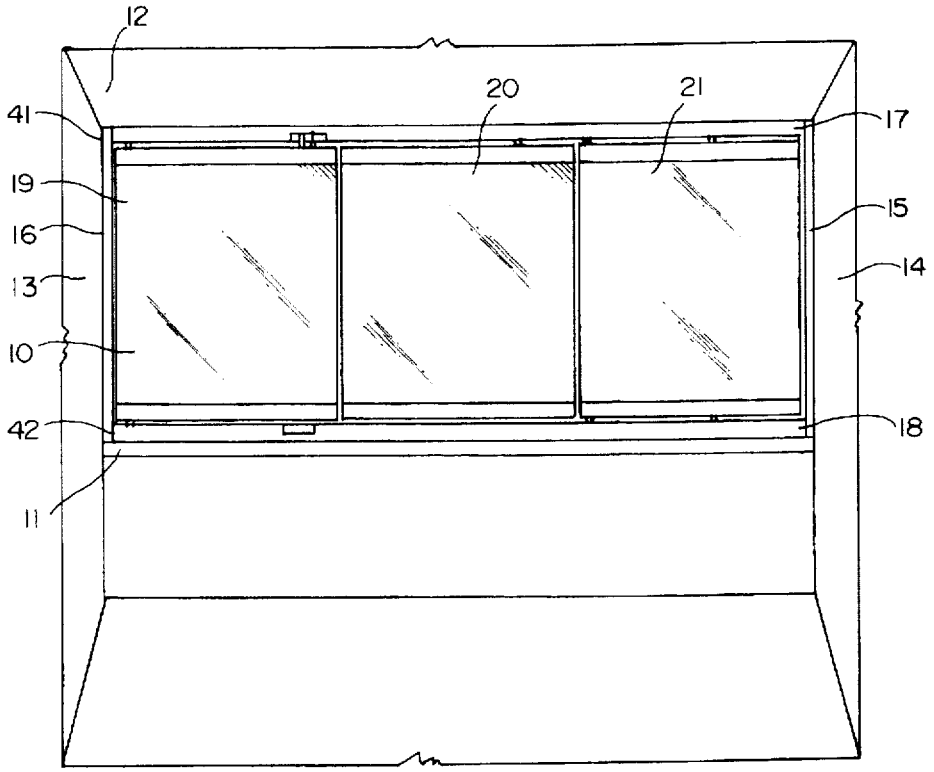
FIG. 1 is a general view of the subject assembly installed between the top of a balcony railing and the ceiling of the balcony as viewed from the balcony.

The subject invention is an extensible retractable panel assembly. In FIG. 1, a view of the assembly in its extended (closed) condition, assembly 10 is installed between balcony railing top 11, ceiling 12 and balcony sides 13 and 14. The balcony sides may serve as side members for the assembly or, as illustrated, side members 15 and 16 may be used. Upper guide 17 is attached to the ceiling and lower guide 18 is attached to the railing top.

Figure 2:
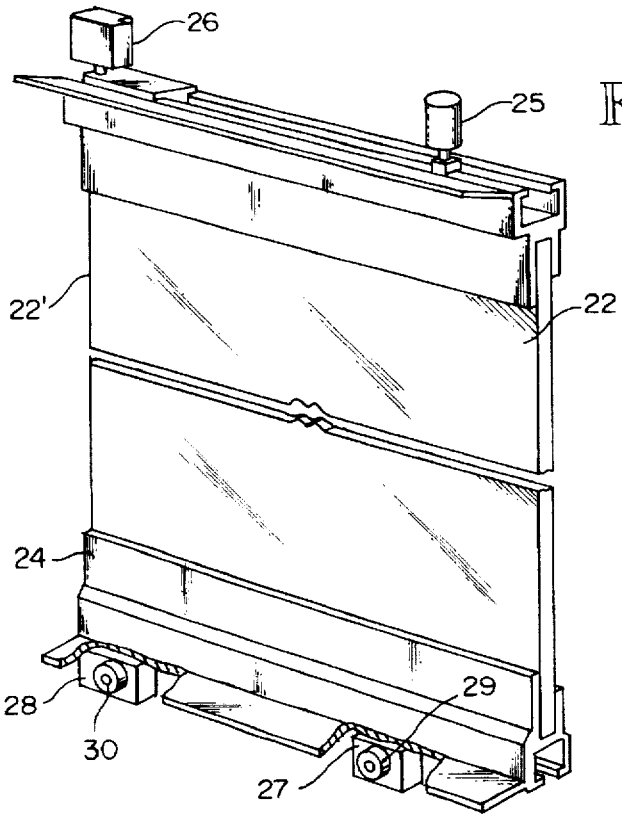
FIG. 2 is a view of a panel subassembly.

The assembly comprises a plurality of panel subassemblies, panel subassemblies 19, 20 and 21 in this view. FIG. 2 illustrates panel subassembly 20 which comprises a glass panel 22, an upper fitting 23, a lower fitting 24, guide fitting 25 installed on fitting 23, pivotally connected guide fitting 26, also installed on fitting 23, non-pivoted guide fitting assembly 27 installed on fitting 24 and pivoted guide fitting assembly 28, also installed on fitting 24. The axes of the pivoted fittings and fitting assemblies are parallel to the edges of the panels, edge 22' being typical. Fitting assemblies 27 and 28 comprise rollers 29 and 30 respectively. The panel subassembly is supported on these rollers which engage flange 31 of lower guide 18 shown in FIG. 3. Guide 18 comprises a channel 32 having an outer wall 33 and an inner wall 34.

FIG. 4 illustrates the upper guide 17 which is similar to guide 18 and has notch 36 in its inner side wall 37. The purposes of notch 36, arm 38 and roller 39 attached to its end are explained below. Arm 38 extends from the inner wall just adjacent to edge 40 of notch 36. In the subject assembly the guide fitting and guide fitting assemblies move in the channels of the guides.

FIG. 5 illustrates a specialized panel subassembly. Subassembly 19 is specialized in that it does not slide in the guides. The pivoted fittings 26' and fitting assembly 28' are fastened in the guides 17 and 18 at guide ends 41 and 42 (FIG. 1) so that the panel subassembly 19 pivots on the pivot axes of the guide and guide assembly. There is no roller on the fitting assembly 28'. Also, guide fitting 27' has no roller and is free to slide in fitting 24' so that it can be moved to engage edge 43 (FIG. 3) of notch 35 to lock the panel subassembly in its extended (closed) position.

FIG. 6 shows the assembly with subassemblies 19, 20 and 21 in the retracted positions. The distances of guide fittings 25' and 25" and 27' and 27" (not visible in this view) from edge(s) 22' are determined by the positions of the edges in their retracted positions and notches 35 and 36 through which the non-pivoted guide fitting and fitting assembly pass when each panel is pivoted to the retracted position. Non-pivoted guide fitting 27' on subassembly 19 is accessible through notch 36 for use as a handle to pull panel subassembly 19 open.

There is a lock spring, spring 44 in FIG. 6 being typical, for each slidable panel subassembly, subassemblies 20 and 21 in this case. FIG. 7 illustrates a slide block 45 of guide fitting 26' having a notch 46 which is engaged by end 47 of spring 44 after the slide block has moved past the spring as the panel subassembly is moved to its retracted position. The engagement of the spring and slider block retains the panel subassembly in the retracted position and limits the tilting of the panel subassembly which tends to occur when fitting 27 is aligned with notch 35 (see FIG. 2). When the panel subassembly is being extended, the first move is to pivot it back into alignment with the guides. As it is turned, cam 48 on part 49 engages the end of the spring and disengages it from the notch, freeing the slider block to move past the spring.

FIG. 8 is a schematic illustration of the disengagement of the lock spring and slide block 45 by the cam 48 on part 49 of guide fitting assembly 26. Also, not shown in this view, guide fitting 25 engages surface 50 of arm 38 (FIG. 4) to move the subassembly including the slide block to relieve the load forces between the spring and block during the disengagement by the cam action.

It is considered to be understandable from this description that the subject invention meets its objectives. It provides a panel assembly usable to enclose balconies and the like with the panel assembly supported from below. Extension and retraction of the assembly do not require manipulating levers or the panel subassemblies. The mechanism for locking the assembly in its retracted condition is simple and reliable.

It is also considered to be understood that while one embodiment of the subject invention is disclosed herein, other embodiments and modifications of the one disclosed are possible within the scope of the invention which is limited only by the scope of the attached claims.

I claim:

1. An extensible/retractable panel assembly having a retracted end, a retracted condition and comprising:

an upper guide, a lower guide and a plurality of panel subassemblies, each of said subassemblies having a vertical edge and an outer surface and an inner surface, one of said subassemblies being pivotally attached to said upper and lower guides at said retracted end about an axis near to and parallel to said vertical edge, the remainder of said subassemblies further comprising:

an upper fitting, a lower fitting, a pivoted guide fitting assembly and a guide fitting attached to said upper fitting and a pivoted guide fitting assembly and a guide fitting assembly attached to said lower fitting, said guide fitting assemblies and said guide fitting engaging said guides such that said subassemblies are slidable sequentially to said retracted end and pivotable on said pivoted guide fitting assemblies such that in said retracted condition said inner surfaces and said outer surfaces interface with each other, said upper guide comprising a channel having an outer flange and an inner flange, said outer flange having an inner surface, said assembly further comprising a plurality of leaf springs, one for each of said remainder of subassemblies, each of said plurality of leaf springs engaging said pivoted guide fitting assembly attached to said upper fitting when said subassemblies are in said retracted condition, said pivoted guide fitting assemblies attached to said upper fittings further comprising cam means for disengaging said leaf springs from said pivoted guide fitting assemblies when said subassemblies are positioned to slide in said guides, said guide fittings and said guide fitting assemblies attached to said lower fittings further comprising rollers which engage said lower guide to support said subassemblies.

2. The assembly of claim 1 in which said assembly further comprises cam means attached to said upper guide and engagable by said guide fittings attached to said upper fixtures such that said subassemblies are stabilized when being pivoted on said pivoted guide fitting assemblies.

* * * * *